US008087512B2

(12) United States Patent
Brand

(10) Patent No.: US 8,087,512 B2
(45) Date of Patent: Jan. 3, 2012

(54) CARTON WITH HANDLE, CENTRAL FLAP AND DIVIDER

(75) Inventor: Kirsten L. Brand, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/821,657

(22) Filed: Jun. 23, 2010

(65) Prior Publication Data

US 2010/0320098 A1 Dec. 23, 2010

Related U.S. Application Data

(60) Provisional application No. 61/219,633, filed on Jun. 23, 2009.

(51) Int. Cl.
*B65D 75/00* (2006.01)

(52) U.S. Cl. ..... 206/187; 206/176; 206/191; 206/193

(58) Field of Classification Search ..... 206/162, 206/173–176, 178, 180–181, 193, 198, 187, 206/191

See application file for complete search history.

(56) References Cited

U.S. PATENT DOCUMENTS

| | | | |
|---|---|---|---|
| 2,225,822 | A | 12/1940 | Crook |
| 2,227,330 | A | 12/1940 | Turner |
| 2,331,312 | A | 10/1943 | Dorfman |
| 2,336,857 | A | 12/1943 | Gies et al. |
| 2,460,108 | A | 1/1949 | Smith et al. |
| 2,689,061 | A | 9/1954 | Gray |
| 2,721,001 | A | 10/1955 | Hasselhoff |
| 2,776,072 | A | 1/1957 | Forrer |
| 2,783,916 | A | 3/1957 | Hodapp |
| 3,029,977 | A | 4/1962 | Arneson |
| 3,053,411 | A | 9/1962 | Struble et al. |
| 3,128,906 | A | 4/1964 | Forrer |
| 3,190,487 | A | 6/1965 | Wood |
| 3,191,800 | A | 6/1965 | Kowal |
| 3,194,478 | A | 7/1965 | Weiss |
| 3,229,849 | A | 1/1966 | Spillson |
| 3,236,414 | A | 2/1966 | Slevin, Jr. |
| 3,313,466 | A | 4/1967 | Keith |

(Continued)

FOREIGN PATENT DOCUMENTS

DE 9004439 U1 6/1990

(Continued)

OTHER PUBLICATIONS

International Search Report and Written Opinion for PCT/US2010/039607, dated Mar. 2, 2011.

*Primary Examiner* — Bryon Gehman

(74) *Attorney, Agent, or Firm* — Womble Carlyle Sandridge & Rice, LLP

(57) ABSTRACT

A carrier comprises a first side panel, a second panel, and at least one handle panel. A central flap is foldably connected to the at least one handle panel, and the central flap divides the interior of the carrier into at least a first container-receiving space and a second container-receiving space. A divider comprises at least one divider panel, wherein the at least one divider panel extends generally parallel to the central flap, and at least one divider flap foldably connected to the at least one divider panel to divide a respective one of the first container-receiving space or the second container-receiving space into at least two container compartments.

44 Claims, 10 Drawing Sheets

U.S. PATENT DOCUMENTS 3,343,742 A 9/1967 Siegler
3,351,230 A * 11/1967 Schuster ..... 206/187
3,432,073 A 3/1969 Forrer
3,554,401 A 1/1971 Wood
3,624,790 A 11/1971 Stout
3,661,297 A 5/1972 Wood
3,669,306 A 6/1972 Forrer
3,672,539 A 6/1972 Forrer
3,721,335 A 3/1973 Grant
3,754,680 A 8/1973 Wood
3,784,053 A 1/1974 Stout
3,860,113 A 1/1975 Helms
3,917,059 A 11/1975 Wood
3,917,060 A 11/1975 Wood
3,917,061 A 11/1975 Stout
4,000,813 A 1/1977 Stout
4,010,847 A 3/1977 Wood et al.
4,153,158 A 5/1979 Graser et al.
4,171,046 A 10/1979 Boczynk
4,205,748 A 6/1980 Wilson
4,217,983 A 8/1980 Stout
4,243,138 A 1/1981 Wilson
4,250,992 A 2/1981 Gilbert
4,253,564 A 3/1981 Engdahl, Jr.
4,308,950 A 1/1982 Wood
4,319,682 A 3/1982 Wright et al.
4,362,240 A 12/1982 Edward
4,374,561 A 2/1983 Stout et al.
4,406,365 A 9/1983 Kulig
4,413,729 A 11/1983 Wood
4,450,956 A 5/1984 Wood
4,480,746 A 11/1984 Wood
4,544,092 A 10/1985 Palmer
4,591,090 A 5/1986 Collins et al.
4,722,437 A 2/1988 Walsh
4,770,294 A 9/1988 Graser
4,792,038 A 12/1988 Cooper
4,798,285 A * 1/1989 Hernandez ..... 206/180
4,927,009 A 5/1990 Stout
5,029,698 A 7/1991 Stout
5,040,672 A 8/1991 DeMaio et al.
5,072,876 A 12/1991 Wilson
5,123,588 A 6/1992 Harris
5,191,976 A 3/1993 Stout et al.
5,246,113 A 9/1993 Schuster
5,282,348 A 2/1994 Dampier et al.
5,359,830 A 11/1994 Olson et al.
5,363,954 A 11/1994 Dampier et al.
5,400,901 A 3/1995 Harrelson
5,458,234 A 10/1995 Harris
5,482,203 A 1/1996 Stout
5,484,053 A 1/1996 Harris
5,499,712 A 3/1996 Harrelson
5,518,110 A 5/1996 Harrelson
5,531,319 A 7/1996 Harrelson
5,538,130 A 7/1996 Harrelson
5,538,131 A 7/1996 Harrelson
5,579,625 A 12/1996 Olson et al.
5,590,762 A 1/1997 Harrelson
5,593,027 A 1/1997 Sutherland
5,620,094 A 4/1997 Naumann
5,638,956 A 6/1997 Sutherland
5,645,162 A 7/1997 Harrelson
5,649,620 A 7/1997 Harrelson
5,657,864 A 8/1997 Harrelson
5,657,865 A 8/1997 Harrelson
5,680,930 A 10/1997 Stone
5,682,982 A 11/1997 Stonehouse
5,695,051 A 12/1997 Hart
5,765,685 A 6/1998 Roosa
5,775,487 A 7/1998 Harrelson
5,819,920 A 10/1998 Sutherland
5,855,316 A 1/1999 Spivey
5,871,090 A 2/1999 Doucette et al.
5,878,877 A 3/1999 Sutherland
5,884,756 A 3/1999 Holley, Jr. et al.
5,947,273 A 9/1999 Dalrymple et al.
6,041,920 A 3/2000 Hart et al.
6,112,977 A 9/2000 Sutherland et al.
6,131,729 A 10/2000 Eckermann et al.
6,155,962 A 12/2000 Dalrymple et al.
6,168,013 B1 1/2001 Gomes
6,230,881 B1 5/2001 Collura
6,247,585 B1 6/2001 Holley, Jr.
6,315,111 B1 11/2001 Sutherland
6,341,689 B1 1/2002 Jones
6,371,287 B1 4/2002 Jones
6,695,137 B2 2/2004 Jones et al.
6,736,260 B2 5/2004 Gomes et al.
6,802,802 B2 10/2004 Woog
6,814,228 B2 11/2004 Sutherland
6,938,756 B2 9/2005 Schuster
7,011,209 B2 3/2006 Sutherland et al.
7,025,197 B2 4/2006 Sutherland
7,070,045 B2 7/2006 Theelen
7,128,206 B2 10/2006 Kohler
7,207,934 B2 4/2007 Schuster
7,374,038 B2 5/2008 Smalley
7,448,492 B2 11/2008 Sutherland
7,472,791 B2 1/2009 Spivey, Sr.
7,552,820 B2 6/2009 Kohler
7,604,116 B2 10/2009 Schuster
7,644,817 B2 1/2010 Sutherland
7,677,387 B2 3/2010 Brand et al.
7,762,395 B2 7/2010 Sutherland et al.
7,762,397 B2 7/2010 Coltri-Johnson et al.
7,793,780 B2 9/2010 Smalley
2002/0077236 A1 6/2002 Chalendar et al.
2002/0117407 A1 8/2002 Holley
2003/0159950 A1 8/2003 Jones et al.
2004/0050722 A1 3/2004 Schuster
2004/0094435 A1 5/2004 Auclair et al.
2005/0211577 A1 9/2005 Bakx
2005/0218014 A1 10/2005 Schuster
2005/0230273 A1 10/2005 Kohler
2006/0148629 A1 7/2006 Cuomo
2006/0157545 A1 7/2006 Auclair
2007/0151873 A1 7/2007 Schuster
2008/0210581 A1 9/2008 Brand
2010/0006458 A1 1/2010 Wilkins et al.

FOREIGN PATENT DOCUMENTS

EP 1 319 607 A1 6/2003
WO WO 97/05026 2/1997

* cited by examiner

CARTON WITH HANDLE, CENTRAL FLAP AND DIVIDER

CROSS-REFERENCE TO RELATED APPLICATIONS

This application claims the benefit of U.S. Provisional Patent Application No. 61/219,633, filed Jun. 23, 2009.

INCORPORATION BY REFERENCE

U.S. Provisional Application No. 61/219,633, which was filed on Jun. 23, 2009, is hereby incorporated by reference for all purposes as if presented herein in its entirety.

BACKGROUND OF THE DISCLOSURE

The present disclosure relates to a carton for holding a plurality of containers. More specifically, the present disclosure relates to a basket-type carton having a handle and a plurality of container compartments for holding containers in two or more container-receiving spaces.

SUMMARY OF THE DISCLOSURE

In general, one aspect of the disclosure is directed to a carrier for holding a plurality of containers. The carrier comprises a plurality of panels that extend at least partially around an interior of the carrier. The panels comprise a first side panel, a second panel, and at least one handle panel. A central flap is foldably connected to the at least one handle panel, and the central flap divides the interior of the carrier into at least a first container-receiving space and a second container-receiving space. A divider comprises at least one divider panel, wherein the at least one divider panel extends generally parallel to the central flap, and at least one divider flap foldably connected to the at least one divider panel to divide a respective one of the first container-receiving space or the second container-receiving space into at least two container compartments.

In another aspect, the disclosure is generally directed to a combination of a carrier blank and a divider blank for forming a carrier for holding a plurality of containers. The carrier blank comprises a plurality of panels comprising a first side panel, a second panel, and at least one handle panel, and a central flap foldably connected to the at least one handle panel. The central flap is for dividing the interior of the carrier into at least a first container-receiving space and a second container-receiving space. The divider blank comprises at least one divider panel and at least one divider flap foldably connected to the at least one divider panel. The at least one divider panel at least partially overlaps the at least one handle panel and at least one of the first side panel and the second side panel.

In another aspect, the disclosure is generally directed to a method of forming a carrier for holding a plurality of containers. The method comprises obtaining a carrier blank comprising a plurality of panels comprising a first side panel, a second panel, at least one handle panel, and a central flap foldably connected to the at least one handle panel. The method further comprises obtaining a divider blank comprising at least one divider panel and at least one divider flap foldably connected to the at least one divider panel, positioning the at least one divider panel to at least partially overlap at least the first side panel and the at least one handle panel, and forming an interior of the carrier by folding the panels of the plurality of panels about respective fold lines so that the first side panel is positioned opposite to the second side panel and the central panel divides the carrier into a first container-receiving space and a second container-receiving space.

In another aspect, the disclosure is generally directed to a carrier for holding a plurality of containers. The carrier comprises a plurality of panels that extend at least partially around an interior of the carrier. The panels comprise a first side panel, a second panel, and at least one handle panel. At least one first end flap is foldably connected to at least one panel of the plurality of panels and at least partially closes a first end of the carrier. The at least one handle panel is foldably connected to the at least one first end flap at a first handle end. A central flap is foldably connected to the at least one handle panel at a second handle end. The central flap divides the interior of the carrier into at least a first row and a second row.

In another aspect, the disclosure is generally directed to a carrier blank for forming a carrier for holding a plurality of containers. The carrier blank comprises a plurality of panels comprising a first side panel, a second panel, and at least one handle panel. At least one first end flap is foldably connected to at least one panel of the plurality of panels for at least partially closing a first end of the carrier formed from the carrier blank. The at least one handle panel is foldably connected to the at least one first end flap at a first handle end. A central flap is foldably connected to the at least one handle panel at a second handle end. The central flap is for dividing the interior of the carrier formed from the carrier blank into at least a first container-receiving space and a second container-receiving space.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION OF THE EXEMPLARY EMBODIMENT

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage containers (e.g., glass bottles or plastic containers) at least partially disposed within the carrier embodiments. In this specification, the terms "lower," "bottom," "upper," "top," "front," and "back" indicate orientations determined in relation to fully erected carriers.

Figure 1:
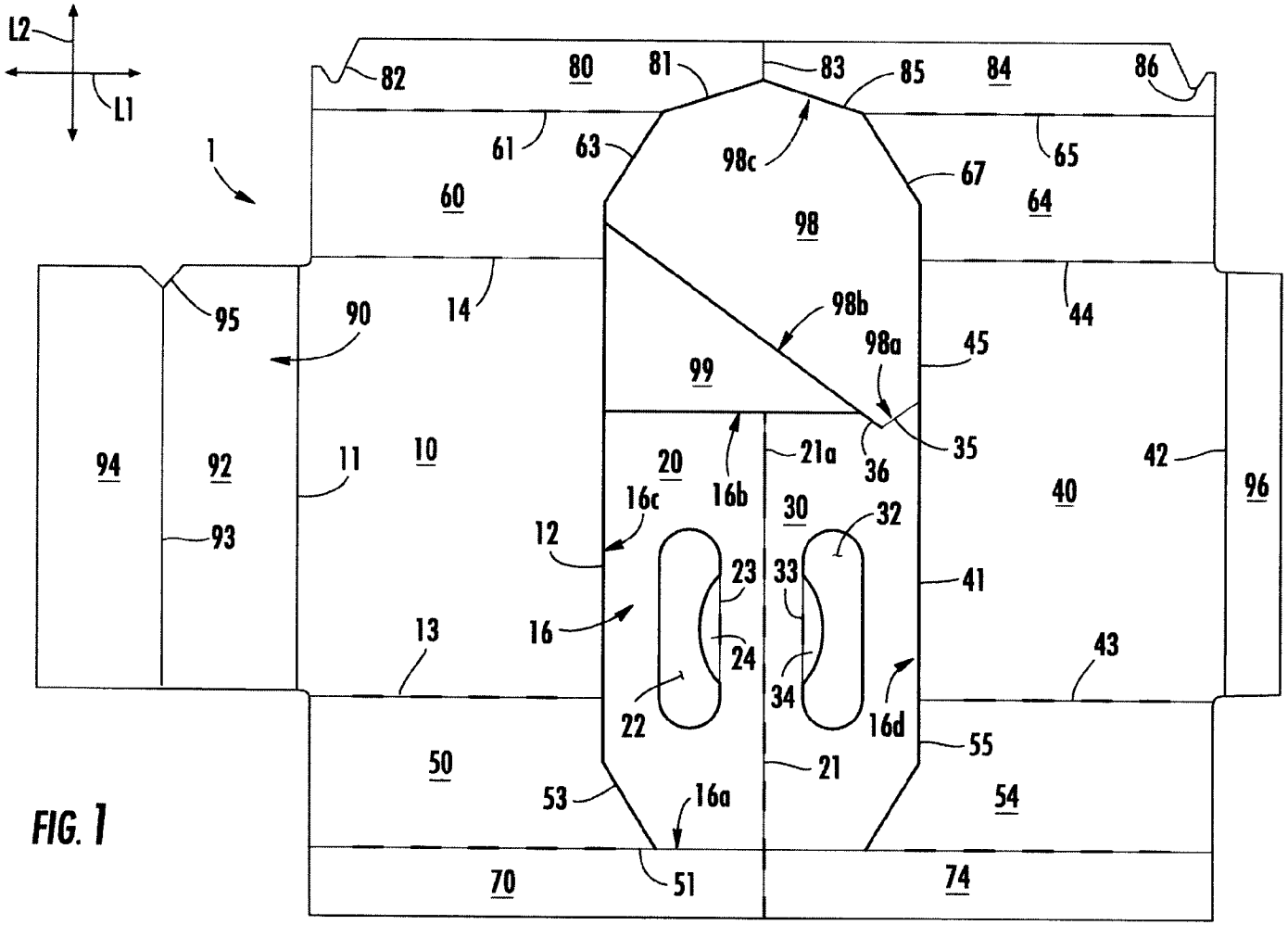
FIG. 1 is a plan view of an exterior of a carrier blank for forming a carrier according to one embodiment of the disclosure.
Figure 2:
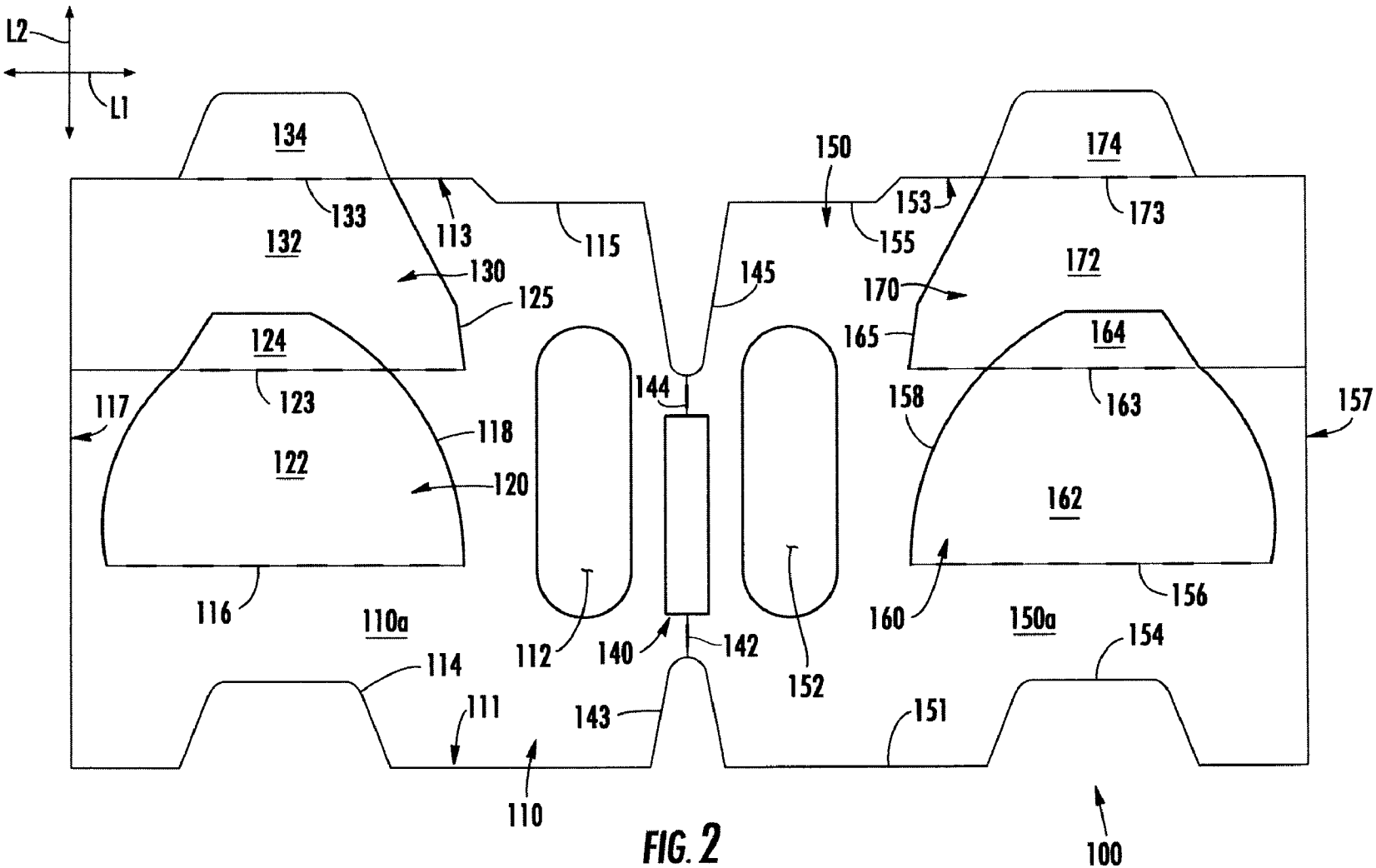
FIG. 2 is a plan view of an exterior of a divider blank used to form a divider for the carrier.
Figure 7:
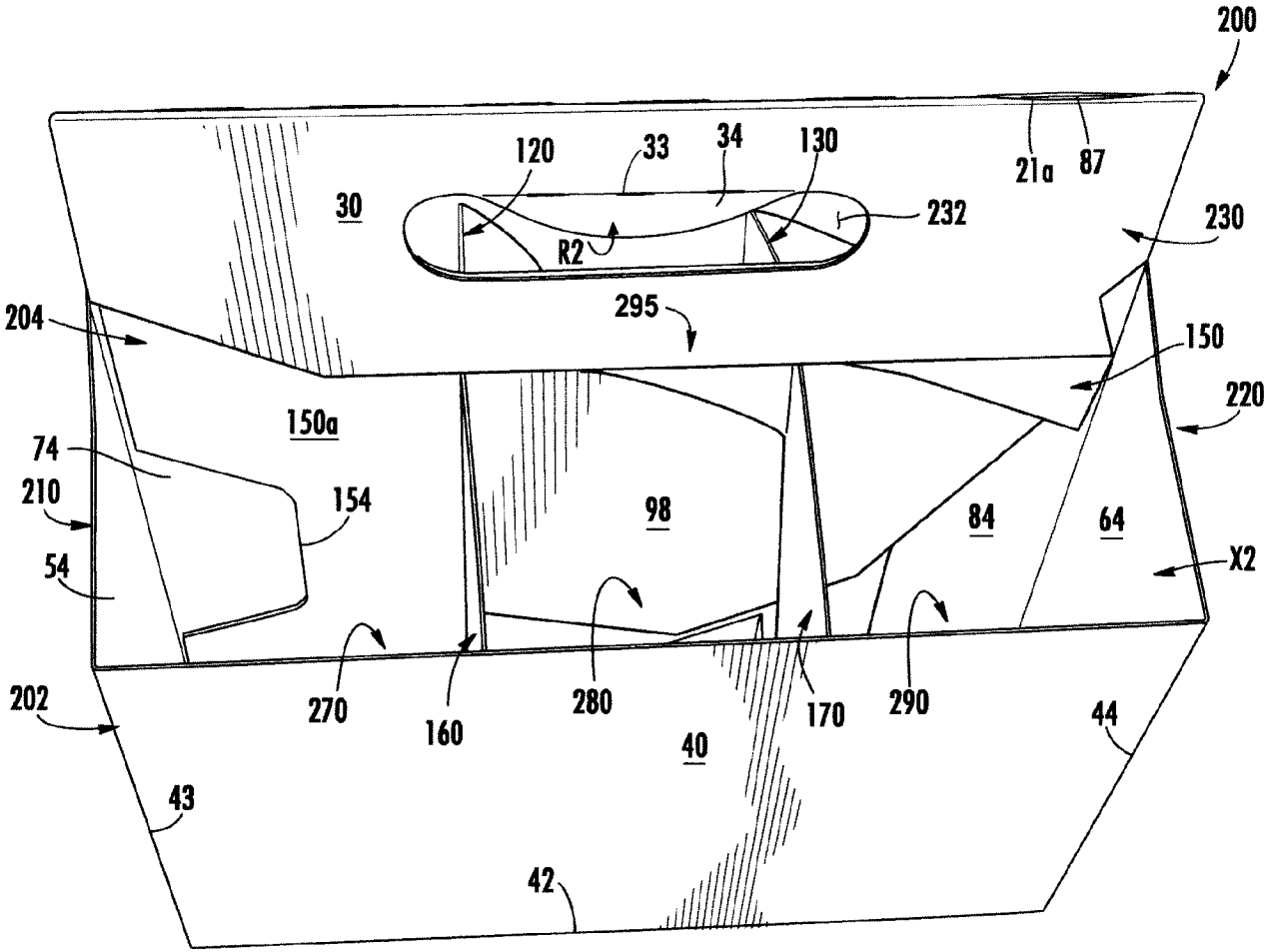
FIG. 7 is a perspective view of the exemplary carrier according to one embodiment of the disclosure showing a container-receiving space.
Figure 9:
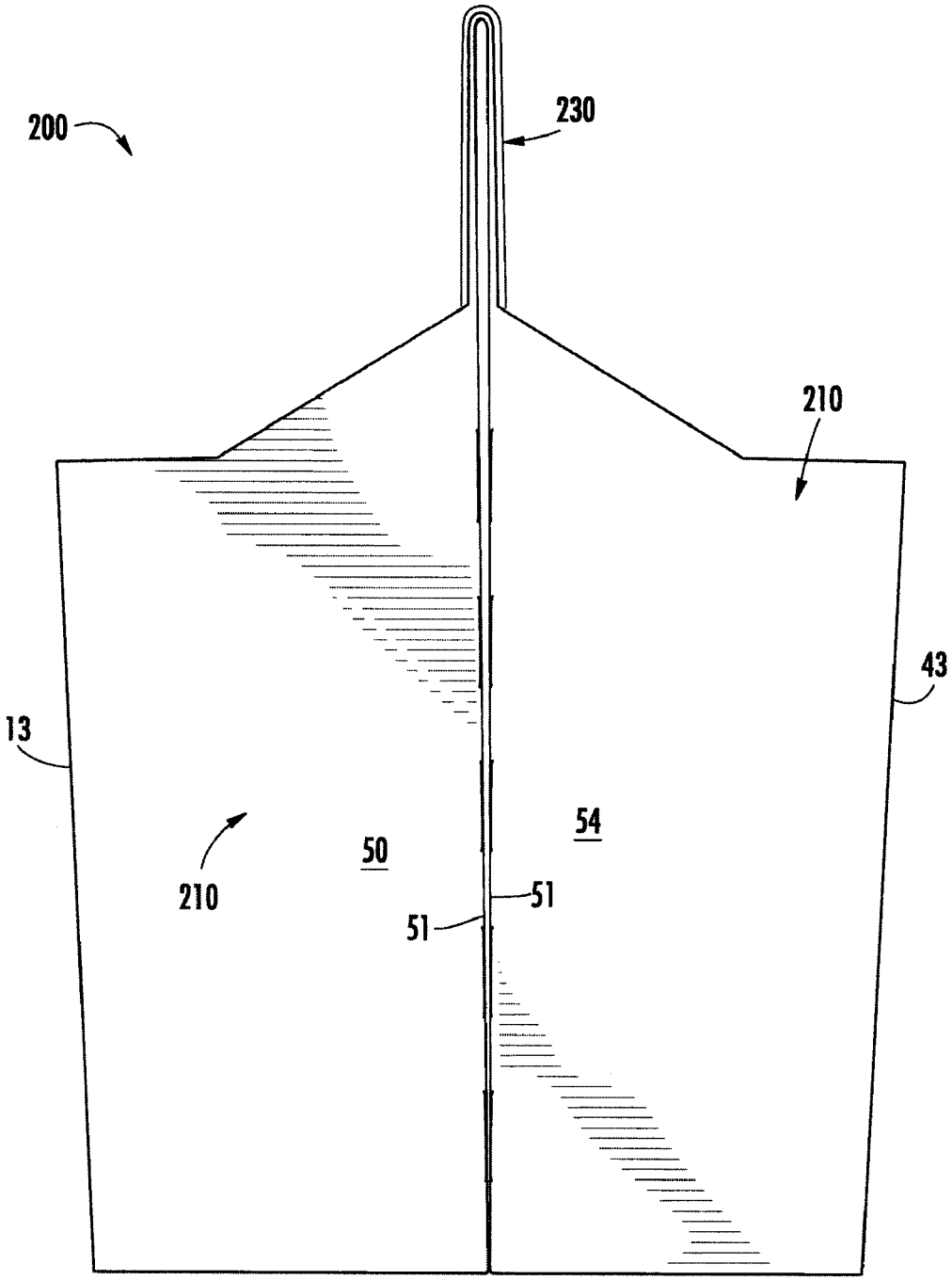
FIG. 9 is a perspective view of an end of the carrier of FIG. 7.
Figure 10:
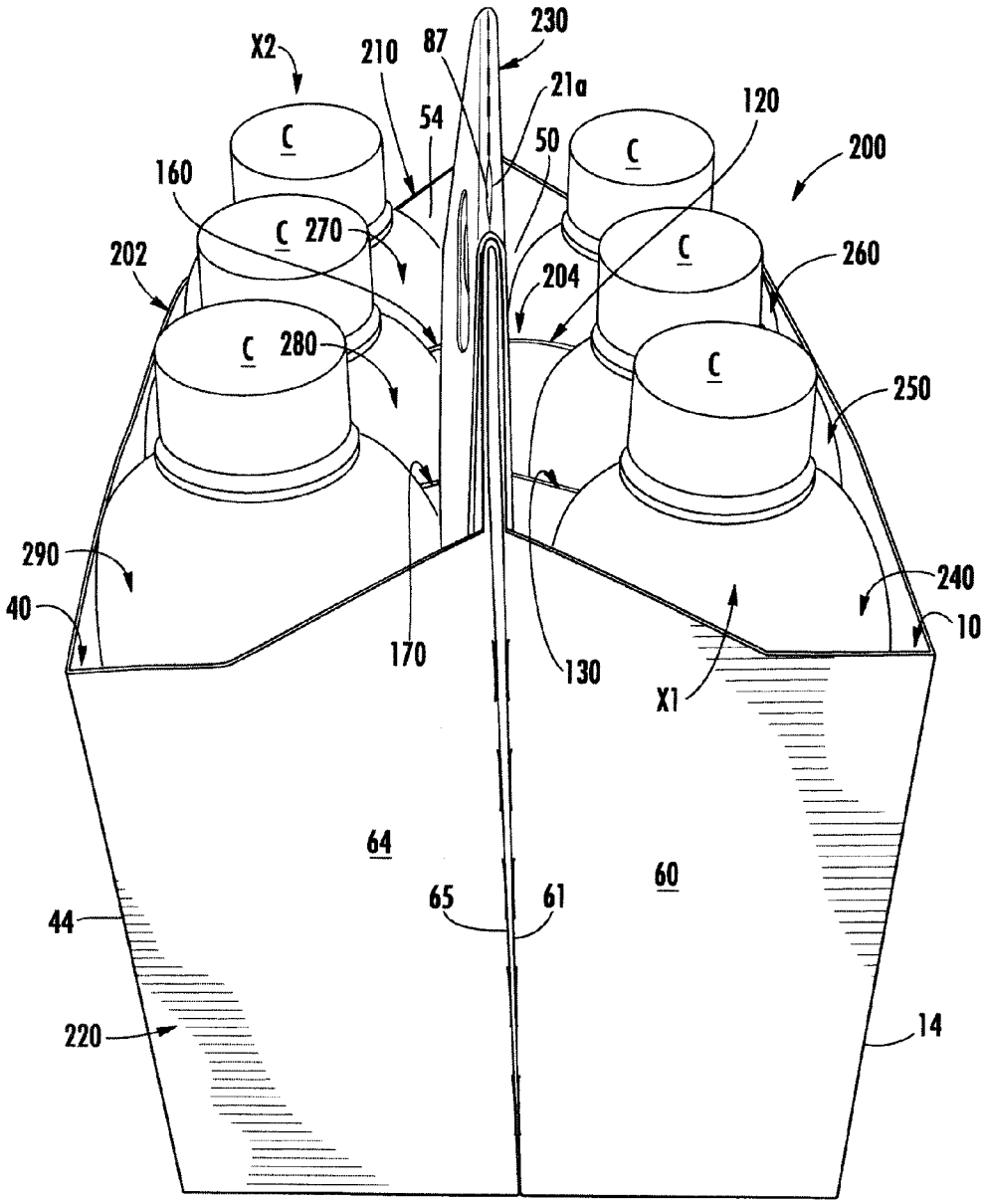
FIG. 10 is a perspective view of the carrier of FIG. 7 with a plurality of containers received in the container-receiving spaces.

FIGS. 1 and 2 respectively show a carrier blank 1 and a divider blank 100 for forming a carrier 200 with a divider 204 (FIGS. 7-10) in accordance with an exemplary embodiment of the present disclosure. As shown in FIG. 10, the carrier 200 is sized to contain six containers C, three being contained in a first container-receiving space X1 (FIG. 8) and three container being contained in a second container-receiving space X2 (FIG. 7). The carrier 200 can be sized to contain more or less than six containers and each container-receiving space X1, X2 can be sized to contain more or less than three containers each.

The carrier blank 1 has a longitudinal axis L1 and a lateral axis L2. As shown in FIG. 1, the carrier blank 1 includes a first side panel 10, a handle panel 16 adjacent the first side panel 10, and a second side panel 40 adjacent the handle panel 16, opposite the first side panel 10. The carrier blank 1 further includes a first end flap 50 foldably connected to a first end of the first side panel 10 at a longitudinal fold line 13, a second end flap 54 foldably connected to a first end of the second side panel 40 at a longitudinal fold line 43, a third end flap 60 foldably connected to a second end of the first side panel 10 at a longitudinal fold line 14, and a fourth end flap 64 foldably connected to a second end of the second side panel 40 at a longitudinal fold line 44.

In the illustrated embodiment, the first and second end flaps 50, 54 include respective first and second end closures 70, 74 foldably connected to the first and second end flaps 50, 54, respectively, at a longitudinal fold line 51. The first and second end closures 70, 74 can be foldably connected to each other at a lateral fold line 21, which extends into the handle panel 16, as will be described below. The third and fourth end flaps 60, 64 can include respective third and fourth end closures 80, 84 foldably connected to the third and fourth end flaps 60, 64, respectively, at respective longitudinal fold lines 61, 65. The third and fourth end closures 80, 84 can be foldably connected to each other at a longitudinal fold line 83 and can include respective corner notches 82, 86. The end closures 70, 74, 80, 84 can be alternatively referred to as closure flaps 70, 74, 80, 84, respectively. The end flaps 50, 54, 60, 64 and end closures 70, 74, 80, 84 are foldable to at least partially close the respective ends 210, 220 of the carrier 200 (FIGS. 9 and 10).

The carrier blank 1 further can include a bottom panel 90, which includes a first bottom panel section 92 foldably connected to the first side panel 10 at a lateral fold line 11, and a second bottom panel section 94 foldably connected to the first bottom panel section 92 at a lateral fold line 93. A V-shaped notch 95 can be provided at an edge of the bottom panel 90, such as at the junction of the bottom panel sections 92, 94. A bottom closure flap 96 is foldably connected to the second side panel 40 at a lateral fold line 42, and is configured to be adhesively or otherwise attached to the second bottom panel section 94 for closing a bottom of the carton 200.

The panels 10, 16, 40, 90, flaps 50, 54, 60, 64, and closures 70, 74, 80, 84, 96 are shown as being substantially rectangular. However, it should be understood that other shapes are possible for these panels.

In the illustrated embodiment, the handle panel 16 is positioned between the first and second side panels 10, 40 and the first and second end flaps 50, 54. The handle panel 16 includes a first handle panel section 20 adjacent the first side panel 10 and a second handle panel section 30 adjacent the second side panel 40 and foldably connected to the first handle panel section 20 at the lateral fold line 21. The first handle panel section 20 includes a first handle panel opening 22, and the second handle panel section 30 includes a second handle panel opening 32. A first finger flap 24 can extend into the opening 22 and can be foldably connected to the first handle panel section 20 at a lateral fold line 23. A second finger flap 34 can extend into the opening 32 and can be foldably connected to the second handle panel section 30 at a lateral fold line 33. A slit 21*a* can be formed collinearly with or proximate the fold line 21 and spaced apart from the longitudinal edge 16*b*.

As shown in FIG. 1, the first and second handle panel sections 20, 30 share a first longitudinal edge 16*a* of the handle panel 16 that is foldably connected to the first and second end closures 70, 74 at the longitudinal fold line 51. The first and second handle panel sections 20, 30 also share a substantially free second longitudinal edge 16*b* of the handle panel 16 that is generally opposite the first longitudinal edge 16*a*. The handle panel 16 further includes a generally free first lateral edge 16*c* at the first handle panel section 20 and a generally free second lateral edge 16*d* at the second handle panel section 30. The first handle panel section 20 is separated from the first side panel 10 at the first lateral edge 16*c* by a substantially straight cut 12, and is separated from the first end flap 50 at the first lateral edge 16*c* by a cut 53 extending from the cut 12. In the embodiment shown in FIG. 1, the cut 53 can have a generally lateral portion and an oblique portion so that the end flap 50 has a partially-angled edge. The second handle panel section 30 is separated from the second side panel 40 at the second lateral edge 16*d* by a substantially straight lateral cut 41, and is separated from the second end flap 54 at the second lateral edge 16*d* by a cut 55 extending from the cut 41. In the embodiment shown in FIG. 1, the cut 55 can have a generally lateral portion and an oblique portion so that the end flap 54 has a partially-angled edge. It should be understood that the cut lines 12, 41, 53, 55 may have different shapes other than those shown and described herein.

According to the exemplary embodiment shown in FIG. 1, the carrier blank 1 further includes a central support flap 98 (broadly "central flap") disposed between the first and second side panels 10, 40 and between the third and fourth end flaps 60, 64. The central support flap 98 can include a pivoting oblique minor edge 98*a* foldably connected to the second handle panel section 30 at an oblique fold line 35. The central support flap 98 has a generally free, oblique major edge 98*b* extending in a generally normal direction with respect to the minor oblique edge 98*a*. The oblique major edge 98*b* is separated from the first and second handle panel sections 20, 30 by a triangular opening 99, and is further separated from the second handle panel section 30 by an oblique cut 36 extending from the fold line 35 to the opening 99. The central support flap 98 further includes a free, substantially major edge 98*c* extending between the oblique minor edge 98*a* and the oblique major edge 98*b*. The major edge 98*c* is separated from the first side panel 10 and the second side panel 40 by the opening 99 and a substantially straight lateral cut 45 extending from the cut 41, respectively. The major edge 98*c* is separated from the third end flap 60 by the opening 99 and a cut 63 extending from the opening 99, and is separated from the fourth end flap 64 by a cut 67 extending from the cut 45. The cuts 63, 67 each can include a generally lateral portion and an oblique portion so that the respective end flaps 60, 64 each has a partially-angled edge. The major edge 98*c* is separated from the third end closure 80 and the fourth end closure 84, respectively, by an oblique cut 81 extending from the cut 63, and an oblique cut 85 extending between the cut 81 and the cut 67. It should be understood that the central support panel 98 may have different shapes than the shape shown and described herein. It should also be understood that the fold line 35, the various cuts 12, 36, 41, 45, 53, 55, 63, 67, 81, 85, the edges 98*a*, 98*b*, 98*c*, and the opening 99 may have shapes that are different than those shown and described. Alternatively, the one or more of the cuts 12, 36, 41, 45, 53, 55, 63, 67, 81, 85 can be replaced with a tear line or other line of weakening.

FIG. 2 illustrates the divider blank 100 for forming a divider 204 (FIGS. 7-10) of the carrier 200 in accordance with the exemplary embodiment of the disclosure. The divider blank 100 includes a first divider panel 110 and a second divider panel 150, which can be mirror images of each other in the illustrated embodiment.

The divider blank 100 has a longitudinal axis L1 and a lateral axis L2. The first divider panel 110 includes a main panel 110*a*, and a first divider flap 120 and a second divider flap 130 adjacent the first divider flap 120 are foldably connected to the first divider panel 110 at the first main panel 110*a*. The main panel 110*a* includes an opening 112 for accommodating a user's hand, a notch 114 disposed at a first longitudinal edge 111 of the panel 110, and a notch 115 disposed at a second longitudinal edge 113 of the panel 110.

The first divider flap 120 is defined by a longitudinal fold line 116 and a substantially arch-shaped cut 118 extending between ends of the lateral fold line 116. The first divider flap 120 includes a major flap portion 122 foldably connected to the main panel portion 110*a* at the fold line 116 and a minor flap portion 124 foldably connected to the major flap portion 122 at a longitudinal fold line 123, which extends from a lateral outer edge 117 of the panel 110 and through the first divider flap 120, where it intersects the cut 118 at longitudinally opposite points on the cut 118, and then extends beyond the first divider flap 120.

The second divider flap 130 can be defined by segments of the longitudinal fold line 123 extending outside of the first divider flap 120, a segment of the cut 118 bounding a free edge of the minor flap portion 124, the second longitudinal edge 113 of the first divider panel 110, and a cut 125 extending from the longitudinal fold line 123 to the second longitudinal edge 113 of the panel 110. The second divider flap 130 includes a major flap portion 132 foldably connected to the main panel portion 110*a* at the fold line 123 and a minor flap portion 134 foldably connected to the major flap portion 132 at a longitudinal fold line 133.

In the embodiment shown in FIG. 2, the second divider panel 150 is foldably connected to the first divider panel 110 at generally collinear, lateral fold lines 142, 144, which are spaced apart by a rectangular cutout 140. V-shaped notches 143, 145 can extend from outer ends of the lateral fold lines 142, 144, respectively. The notch 143 is positioned between the first longitudinal edge 111 of the first divider panel 110 and a first longitudinal edge 151 of the second divider panel 150. The notch 145 is positioned between the notch 115 at the second longitudinal edge 113 of the first divider panel 110 and a notch 155 at a second lateral edge 153 of the second divider panel 150.

As shown in FIG. 2, the second divider panel 150 includes a main panel 150*a*, and a third divider flap 160 and a fourth divider flap 170 adjacent the third divider flap 160 are foldably connected to the second divider panel 110 at the second main panel 150*a*. The main panel 150*a* includes an opening 152 for accommodating a user's hand, a notch 154 disposed at the first longitudinal edge 151 of the panel 150, and a notch 155 disposed at the second longitudinal edge 153 of the panel 150.

The third divider flap 160 is defined by a longitudinal fold line 156 and a substantially arch-shaped cut 158 extending between ends of the longitudinal fold line 156. The third divider flap 160 includes a major flap portion 162 foldably connected to the main panel portion 150*a* at the fold line 156 and a minor flap portion 164 foldably connected to the major flap portion 162 at a longitudinal fold line 163, which extends from a lateral outer edge 157 of the panel 150 and through the third divider flap 160, where it intersects the cut 158 at longitudinally opposite points on the cut 158, and then extends beyond the third divider flap 160.

The fourth divider flap 170 is defined by segments of the longitudinal fold line 163 extending outside of the third divider flap 160, a segment of the cut 158 bounding a free edge of the minor flap portion 164, the second longitudinal edge 153 of the second divider panel 150, and a cut 165 extending from the longitudinal fold line 163 to the second longitudinal edge 153 of the panel 150. The fourth divider flap 170 includes a major flap portion 172 foldably connected to the main panel portion 150*a* at the fold line 163 and a minor flap portion 174 foldably connected to the major flap portion 172 at a longitudinal fold line 173.

Figure 3:
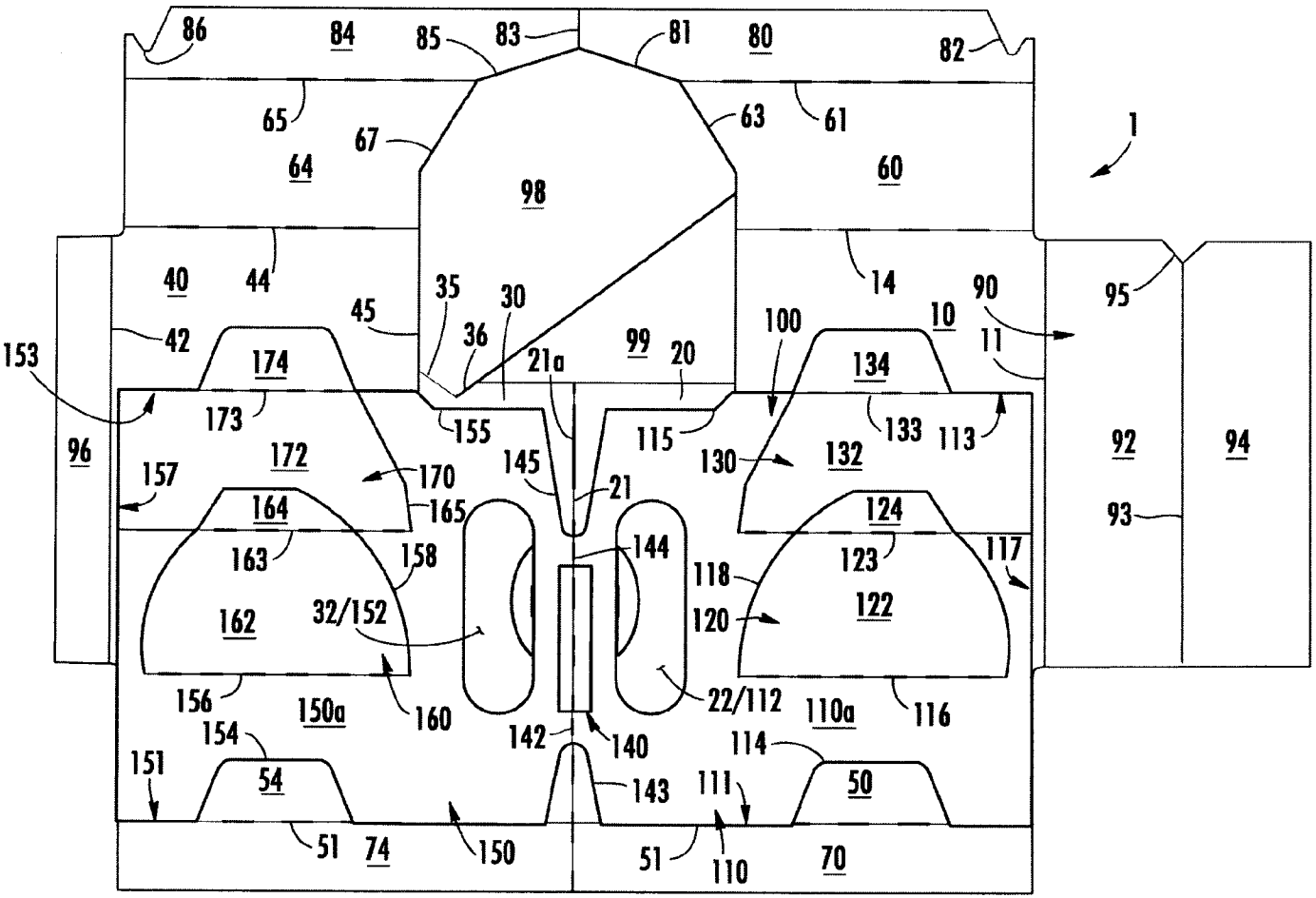
FIG. 3 is a plan view of the carrier blank of FIG. 1 with the divider blank of FIG. 2 applied thereto.

An exemplary method of erecting the carton 200 from the blanks 1, 100 is illustrated in FIGS. 3-7. Referring to FIG. 3, in an exemplary initial stage, the blanks 1, 100 are arranged with their inner sides facing upward, and the blank 100 is placed over the blank 1 such that the outer side of the blank 100 faces the inner side of the blank 1. The blanks 1, 100 are aligned such that the first divider panel 110 overlaps the first handle panel section 20, the first end flap 50, and the first side panel 10, and the second divider panel 150 overlaps the second handle panel section 30, the second end flap 54 and the second side panel 40. In this configuration, the longitudinal outer edges 111, 151 of the respective first and second divider panels 110, 150 are generally aligned with the longitudinal fold line 51 of the carrier blank 1, the first lateral edges 117, 157 of the first and second divider panels 110, 150, respectively, are generally aligned with the lateral fold lines 11, 42, respectively, of the carrier blank 1, and the lateral fold line 21 of the blank 1 is aligned with the rectangular opening 140, the lateral fold lines 142, 144 and the V-shaped notches 143, 145 of the divider blank 100. Additionally, the handle panel openings 22, 32 of the carrier blank 1 are aligned with the openings 112, 152, respectively, of the divider blank 100.

In one embodiment, the outer side of the blank 100 may be adhesively or otherwise attached to the overlapped areas of the blank 1. However, the divider flaps 120, 130, 160, 170 should be free from attachment to the blank 1, so that they can be freely folded with respect to the respective main panel portions 110*a*, 150*a*. For example, the handle panel sections

20, 30 can be adhered to the respective first and second divider panels 110, 150 adjacent the respective openings 112, 152.

Although the above-described preliminary stage is shown and described as including the outer side of the blank 100 facing the inner side of the blank 1, it should be understood that the blank 100 may be arranged such that its outer side faces upward and its inner side faces, and is attached to, the inner side of the blank 1, thus reversing the orientation of the first and second divider panels 110, 150 with respect to the blank 1. However, it may be more aesthetically pleasing to arrange the blanks 1, 100 such that the outer side of the blank 100 faces the inner side of the blank 1, because such an orientation will result in the outer side of the blank 100 being exposed in the erected carton 200.

Figure 4:
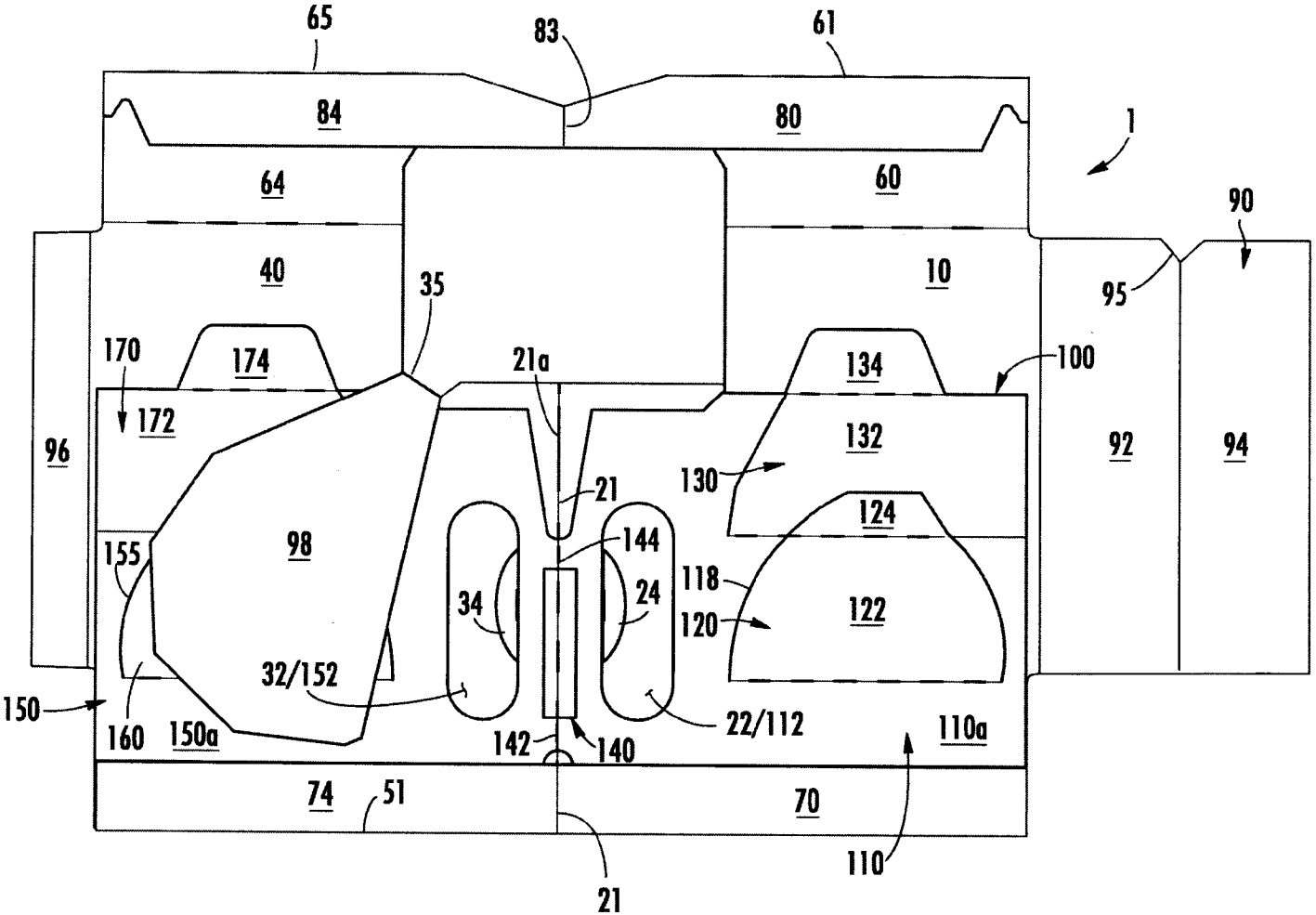
FIGS. 4 and 5 are views showing the folding of the carrier blank and divider blank to form a partially-erected carrier according to one embodiment of the disclosure.

Next, as illustrated in FIG. 4, initial folds may be performed. Specifically, the first and second end closures 70, 74 are folded inwardly about the fold line 51 to be in face-to-face contact with the respective first and second divider panels 110, 150, and the third and fourth end closure flaps 80, 84 are folded inwardly about respective fold lines 61, 65 to be in face-to-face contact with the respective third and fourth end flaps 60, 64. The central support panel 98 is folded inwardly about the oblique fold line 35 such that the outer side of the central support panel 98 faces upward and the central support panel 98 generally is in face-to-face contact with the second divider panel 150, overlapping the third and fourth divider flaps 160, 170.

Figure 5:
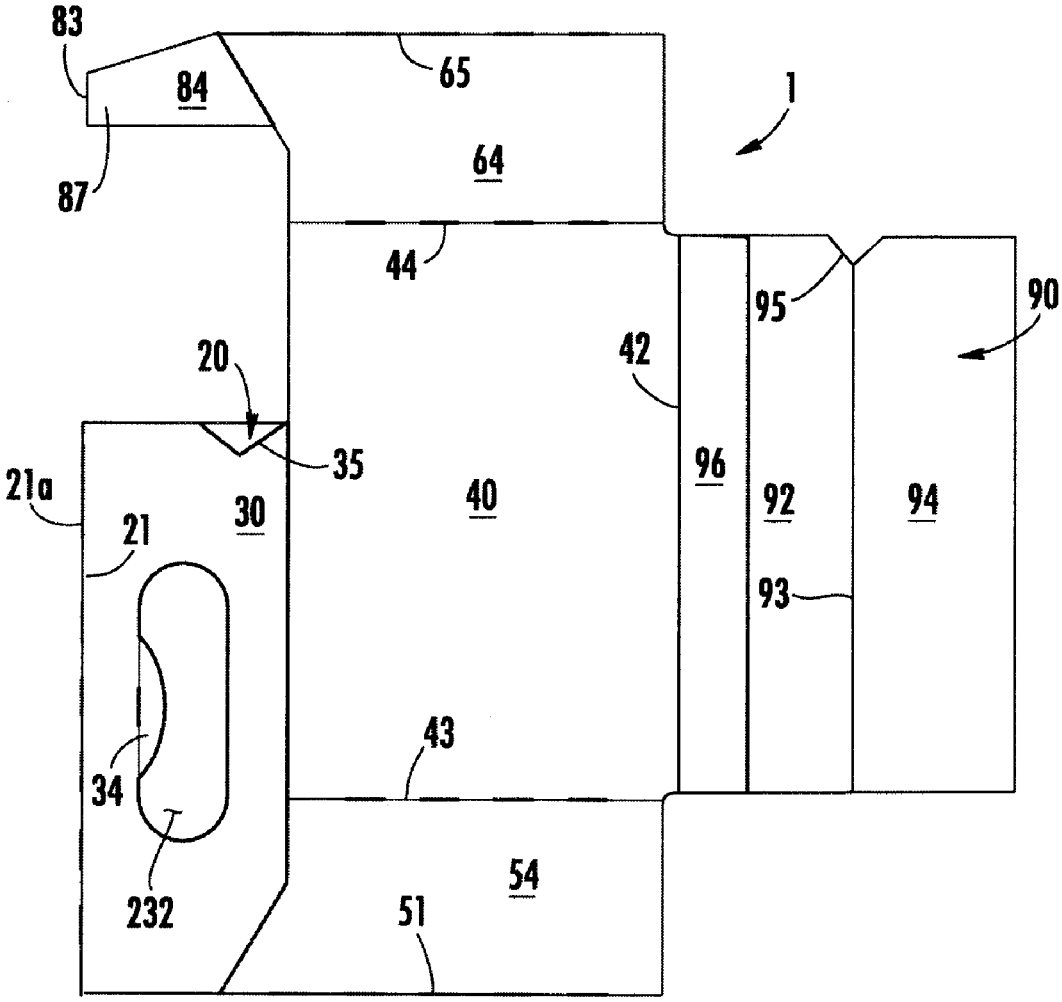

Subsequently, as shown in FIG. 5, the carrier blank 1 may be folded inwardly about the fold lines 21, 83 such that the outer sides of the first and second end closures 70, 74 are generally in face-to-face contact, and the outer sides of the third and fourth end closures 80, 84 are generally in face-to-face contact. As a result of this folding operation, the inner sides of panel 10 and end flaps 50, 60 are pivoted towards the inner sides of panel 40 and end flaps 54, 64, respectively, and the inner side of the first handle panel section 20 is pivoted towards the inner side of the second handle panel section 30. Also as a result of this folding operation, the divider blank 100 is folded inwardly about the fold lines 142, 144 simultaneously with the folding of the carrier blank 1 about the fold lines 21, 83, such that the inner sides of the first and second divider panels 110, 150 face each other and the first and second divider flaps 120, 130 are generally aligned with the third and fourth divider flaps 160, 170, respectively. At this stage, the central support panel 98 is generally disposed between and at least partially in face-to-face contact with both of the first and second divider panels 110, 150. According to one embodiment, the divider panels 110, 150 are adhesively or otherwise attached to the central panel 98. The first and second end closures 70, 74 can be adhesively or otherwise attached to each other, and the third and fourth end closures 80, 84 can likewise be attached to each other. The first and second end closures 70, 74 are generally disposed between the divider panels 110, 150, the end flaps 50, 54, and the handle panel sections 20, 30. The third and fourth end closures 80, 84 form an end closure projection 87 that extends outwardly from the third and fourth end flaps 60, 64.

Figure 6:
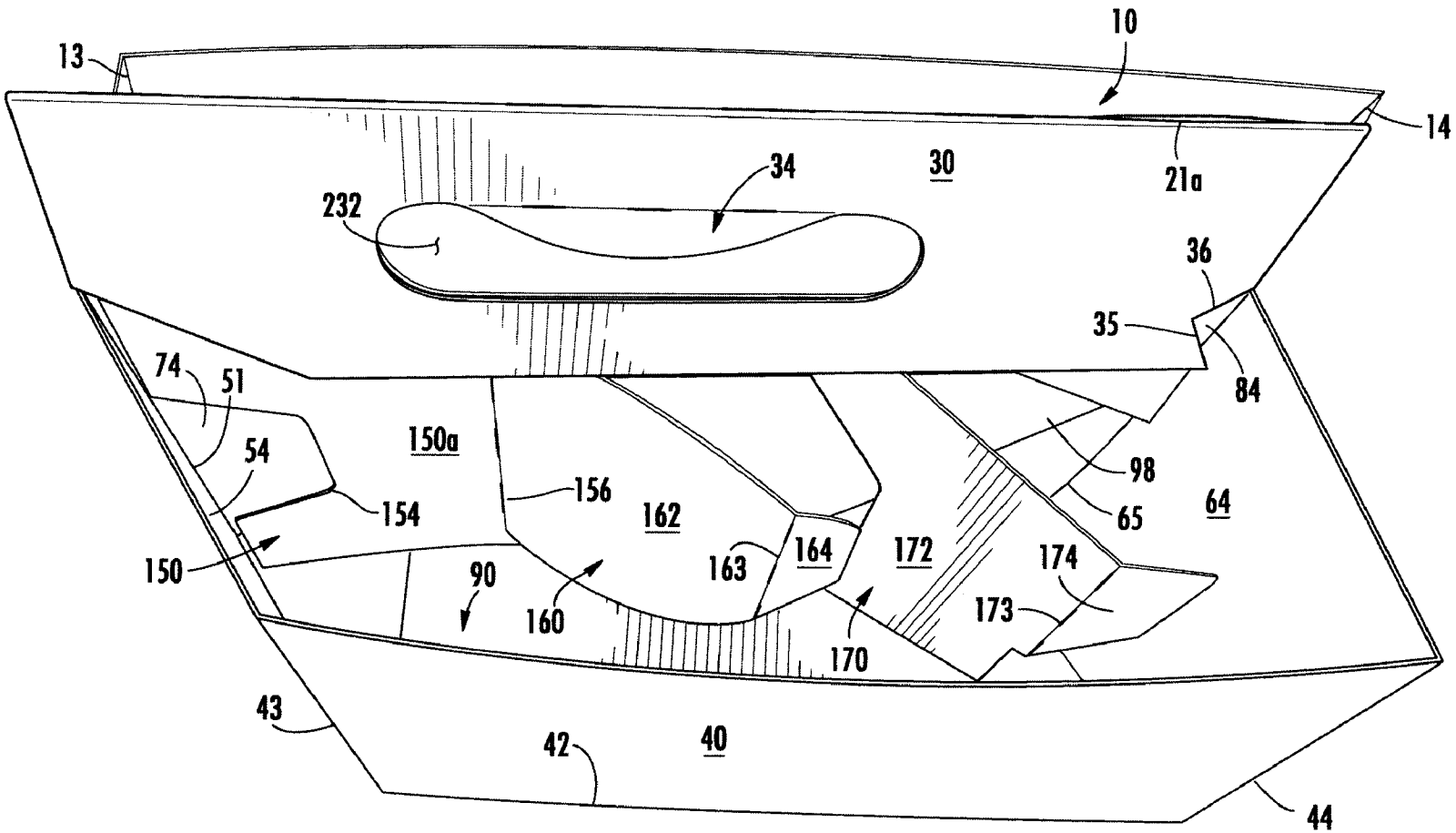
FIG. 6 is a perspective view showing further folding of the partially-erected carrier of FIG. 5 into the carrier according to one embodiment of the disclosure.

Next, as illustrated in FIG. 6, the carrier blank 1 can be folded at the fold lines 13, 14, 43, 44, 51, 61, 65 such that the first and second end flaps 50, 54 are folded to extend in substantially the same plane, and the third and fourth end flaps 60, 64 are folded to extend in substantially the same plane, spaced from and parallel to the first and second end flaps 50, 54. The first and second side panels 10, 40 are thus spaced apart and extend substantially perpendicular to the end flaps 50, 54, 60, 64. Upon the third and fourth end flaps 60, 64 being folded as described, the end closure projection 87 is inserted between the first and second divider panels 110, 150, adjacent the central support panel 98. An end portion of the projection 87 is then inserted through the notch 145 between the first and second divider panels 110, 150, and into the slit 21*a* extending between the first and second handle panel sections 20, 30. The engagement of the end closure projection 87 and the slit 21*a* resists translation of the end closure projection 87 relative to the handle panel 16 so as to resist undesired or unexpected flattening of the carrier 200. The end closure flap projection 87 may be adhesively or otherwise attached to the central support panel 98 and the main panel portions 110*a*, 150*a* of the first and second divider panels 110, 150. Additionally, the inner surfaces of the main panel portions 110*a*, 150*a* may be adhesively or otherwise attached to each other in an area surrounding the openings 112, 152. However, the first and the third divider flaps 120, 160 should remain free from attachment to each other and the second and fourth divider flaps 130, 170 should remain free from attachment to each other.

Subsequent to, or simultaneously with folding the carrier blank 1 at the fold lines 13, 14, 43, 44, the bottom panel 90 may be folded inwardly about the fold line 11 and the bottom closure flap 96 may be folded inwardly about the fold line 42 such that the bottom flap 90 is at least partially in face-to-face contact with the bottom closure flap 96. The bottom panel 90 may then be adhesively or otherwise secured to the bottom closure flap 96 at the second bottom panel section 94.

Figure 8:
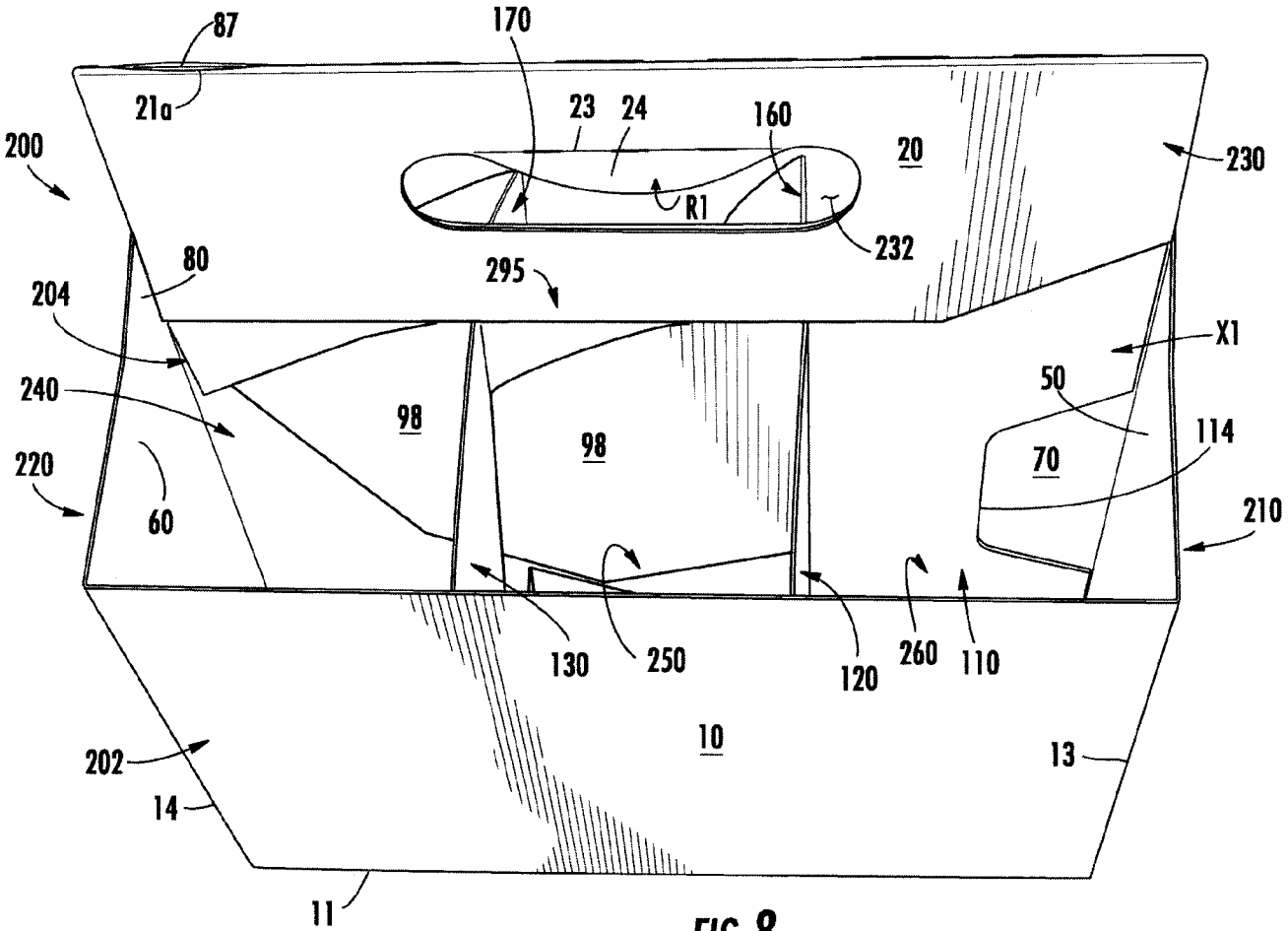
FIG. 8 is a perspective view of the carrier of FIG. 7 showing another container receiving space.

As illustrated in FIGS. 6-8, the first and second divider panel flaps 120, 130 may be folded about respective fold lines 116, 123, such that the first and second divider panel flaps 120, 130 extend transversely between the main panel portion 110*a* and the first side panel 10 (FIG. 8). Similarly, the third and fourth divider panel flaps 160, 170 can be folded about respective fold lines 156, 163, such that the first and second divider panel flaps 160, 170, extend transversely between the main panel portion 150*a* and the second side panel 40 (FIG. 7). The minor flap portions 124, 134 may then be folded along respective fold lines 123, 133 so as to extend substantially parallel to the first side panel 10, and may be adhesively or otherwise attached to the first side panel 10. The minor flap portions 164, 174 may likewise be folded along respective fold lines 163, 173 so as to extend substantially parallel to the second side panel 40, and may be adhesively or otherwise attached to the second side panel 40.

Upon completing the exemplary process described above, the carrier 200 is formed as shown in FIGS. 7-10. The carrier 200, formed by the carrier blank 1, incorporates a divider 204 formed from the divider blank 100 and disposed within the carrier 200. The carrier 200 includes the first and second side panels 10, 40, a first end panel 210 formed by the first and second end flaps 50, 54, a second end panel 220 formed by the third and fourth end flaps 60, 64, the bottom panel 90, an open top 295, and a handle 230 formed by the handle panel sections 20, 30 and extending from the open top 295. The divider 204 defines a plurality of container compartments 240, 250, 260, 270, 280, 290 arranged along the first and second container-receiving spaces X1, X2 in the carton 200 for holding a plurality of containers C, such as, but not limited to, bottles (FIG. 10). The portions of the divider panels 110, 150 proximate the openings 112, 152 are generally in face-to-face contact with the respective handle panel sections 20, 30 so that an upper portion of the divider 204 reinforces the handle 230, and the openings 112, 152 in the divider 204 generally are aligned with the handle panel openings 22, 32 in the handle 230 to form a handle opening 232 for gripping the carrier 200.

As illustrated in FIG. 10, the compartments 240, 250, 260 are formed in a first container-receiving space X1 and the compartments 270, 280, 290 are formed in a second container-receiving space X2. Container-receiving spaces X1, X2 are disposed on opposite sides of the handle 230 and the main panel portions 110*a*, 150*a* of the divider 204. As illustrated in FIGS. 7 and 8, the carrier 200 includes the central support flap 98, which can be secured to the divider 204 and disposed between the main panel portions 110*a*, 150*a*. Thus, the central support panel 98 reinforces the divider 204 and forms a wall that prevents or limits contact between containers C contained in the first container-receiving space X1 and opposing containers C contained in the second container-receiving space X2 (FIG. 10). By limiting contact between containers C in the opposing container-receiving spaces X1, X2, container damage and breakage is less likely, which reduces the likelihood that product contained in the containers C will be wasted during handling of the carrier 200.

As indicated in FIGS. 7 and 8, the first and second finger flaps 24, 34 may be folded upwardly about respective fold lines 23, 33 in the directions R1, R2, respectively, such that they extend transversely to the handle panels 20, 30 in order to provide a more comfortable gripping surface for a user's fingers.

Although the embodiment shown and described includes six container compartments 240, 250, 260, 270, 280, 290 arranged in a 2×3 configuration, it should be understood that modifications are possible to provide more or fewer compartments. For example, each container-receiving space X1, X2 could be configured to form any number of container compartments by changing the number of divider flaps and scaling the size of the blanks 1, 100 appropriately, based on the number and type of containers to be contained in the carton. Further, the carrier 200 can be configured with one or more container-receiving spaces.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The term "line" as used herein includes not only straight lines, but also other types of lines such as curved, curvilinear or angularly displaced lines.

In the present specification, a "panel" need not be flat or otherwise planar. A "panel" can, for example, comprise a plurality of interconnected generally flat or planar sections.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels that extend at least partially around an interior of the carrier, the panels comprising a first side panel, a second side panel, and at least one handle panel;

a central flap foldably connected to the at least one handle panel, the central flap dividing the interior of the carrier into at least a first container-receiving space and a second container-receiving space; and a divider comprising at least one divider panel, wherein the at least one divider panel extends generally parallel to the central flap, and at least one divider flap foldably connected to the at least one divider panel to divide a respective one of the first container-receiving space or the second container-receiving space into at least two container compartments;

wherein at least a portion of the central flap is positioned below the at least one handle panel adjacent the at least one divider panel.

2. The carrier of claim 1, wherein the at least one divider panel comprises a main panel that is at least partially in face-to-face contact with the at least one handle panel.

3. The carrier of claim 2, wherein the at least one divider flap extends from the main panel of the at least one divider panel to one of the first side panel and the second side panel.

4. The carrier of claim 2, wherein the main panel is at least partially in face-to-face contact with the central flap.

5. The carrier of claim 2, wherein the at least one handle panel comprises a first handle panel and a second handle panel.

6. The carrier of claim 5, wherein the at least one divider panel comprises a first divider panel that is at least partially in face-to-face contact with the first handle panel and a second divider panel that is at least partially in face-to-face contact with second handle panel.

7. The carrier of claim 6, wherein the first handle panel comprises a first handle opening, the second handle panel comprises a second handle opening, the first divider panel comprises a third handle opening, and the second divider panel comprises a fourth handle opening, and wherein the first, second, third, and fourth handle openings are generally aligned.

8. The carrier of claim 5, further comprising a first end flap foldably connected to the first side panel and a second end flap foldably connected to the second side panel, the first and second end flaps forming an at least partially closed end of the carrier, wherein the first end flap comprises a first closure flap, and the second end flap comprises a second closure flap at least partially in face-to-face contact with the first closure flap.

9. The carrier of claim 8, wherein the first handle panel is foldably connected to the first closure flap, the second handle panel is foldably connected to the second closure flap, and the first closure flap and the first handle panel are connected to the respective second closure flap and the second handle panel at a lateral fold line.

10. The carrier of claim 9, wherein the at least one divider panel comprises a first divider panel connected to a second divider panel at least one divider fold line that is generally aligned with the lateral fold line.

11. The carrier of claim 9, wherein the closed end of the carrier is a first end, the carrier further comprising a third end flap foldably connected to the first side panel and a fourth end flap foldably connected to the second side panel, the third and fourth end flaps forming an at least partially closed second end of the carrier, wherein the third end flap comprises a third closure flap, and the fourth end flap comprises a fourth closure flap at least partially in face-to-face contact with the third closure flap.

12. The carrier of claim 11, wherein the third and fourth closure flaps at least partially form a closure flap projection that engages a slit extending along the lateral fold line.

13. The carrier of claim 9, wherein the central flap is connected to the at least one handle panel at an oblique fold line, and the first and second handle panels are connected to the respective first and second closure flaps at a longitudinal fold line.

14. The carrier of claim 13, wherein the first and second closure flaps are connected to the respective first and second end flaps at the longitudinal fold line.

15. The carrier of claim 1, wherein the at least one divider panel comprises a first divider panel and a second divider panel, the first divider panel being at least partially in face-to-face contact with a first side of the central flap, and the second divider panel being at least partially in face-to-face contact with a second side of the central flap.

16. The carrier of claim 15, wherein the first divider panel comprises a first main panel and the at least one divider flap comprises a first divider flap foldably connected to the first main panel and adhered to the first side panel, and the second divider panel comprises a second main panel and the at least one divider flap comprises a second divider flap foldably connected to the second main panel and adhered to the second side panel.

17. The carrier of claim 16, wherein the at least one divider flap further comprises a third divider flap foldably connected to the first main panel and adhered to the first side panel and a fourth divider flap foldably connected to the second main panel and adhered to the second side panel.

18. The carrier of claim 1, further comprising a first end flap foldably connected to the first side panel and a second end flap foldably connected to the second side panel, the first and second end flaps at least partially forming an at least partially closed first end of the carton, wherein the at least one handle panel is foldably connected to at least one of the first and second end flaps.

19. The carrier of claim 18, further comprising a third end flap foldably connected to the first side panel and a fourth end flap foldably connected to the second side panel, the third and fourth end flaps at least partially forming an at least partially closed second end of the carton, wherein the second end comprises a projection that interlocks with the at least one handle panel.

20. In combination, a carrier blank and a divider blank for forming a carrier for holding a plurality of containers, the carrier blank comprising:

a plurality of panels comprising a first side panel, a second side panel, and at least one handle panel, wherein at least a portion of the at least one handle panel is separated from the second side panel along a first lateral cut line;

a central flap foldably connected to the at least one handle panel along an oblique fold line, wherein at least a portion of the central flap is separated from the second side panel along a second lateral cut line, the second lateral cut line being collinear with the first lateral cut line, and the oblique fold line extending from the second lateral cut line, the central flap being for dividing the interior of the carrier into at least a first container-receiving space and a second container-receiving space; and the divider blank comprising at least one divider panel and at least one divider flap foldably connected to the at least one divider panel;

wherein the at least one divider panel at least partially overlaps the at least one handle panel and at least one of the first side panel and the second side panel.

21. The carrier blank and divider blank of claim 20, wherein the at least one divider panel comprises a main panel that is at least partially in face-to-face contact with the at least one handle panel.

22. The carrier blank and divider blank of claim 21, wherein the main panel is adhered to the at least one handle panel.

23. The carrier blank and divider blank of claim 21, wherein the at least one divider flap is for being folded relative to the divider panel so as to extend from the main panel of the at least one divider panel to one of the first side panel and the second side panel.

24. The carrier blank and divider blank of claim 21, wherein the at least one handle panel comprises a first handle panel and a second handle panel.

25. The carrier blank and divider blank of claim 24, wherein the at least one divider panel comprises a first divider panel that is at least partially in face-to-face contact with the first handle panel and a second divider panel that is at least partially in face-to-face contact with the second handle panel.

26. The carrier blank and divider blank of claim 25, wherein the first divider panel at least partially overlaps the first side panel and the second divider panel at least partially overlaps the second side panel.

27. The carrier blank and divider blank of claim 25, wherein the first handle panel comprises a first handle opening, the second handle panel comprises a second handle opening, the first divider panel comprises a third handle opening, and the second divider panel comprises a fourth handle opening, and wherein the first and third handle openings are generally aligned and the second and fourth handle openings are generally aligned.

28. The carrier blank and divider blank of claim 24, wherein the carrier blank further comprises a first end flap foldably connected to the first side panel and a second end flap foldably connected to the second side panel, the first end flap comprising a first closure flap and the second end flap comprising a second closure flap, wherein the first and second end flaps are for forming an at least partially closed end of the carton.

29. The carrier blank and divider blank of claim 28, wherein the first handle panel is foldably connected to the first closure flap at a longitudinal fold line, the second handle panel is foldably connected to the second closure flap at the longitudinal fold line, and the first closure flap and the first handle panel are connected to the respective second closure flap and the second handle panel at a lateral fold line.

30. The carrier blank and divider blank of claim 29, wherein the at least one divider panel comprises a first divider panel connected to a second divider panel at least one divider fold line that is generally aligned with the lateral fold line.

31. The carrier blank and divider blank of claim 29, wherein the carrier blank further comprises a third end flap foldably connected to the first side panel and a fourth end flap foldably connected to the second side panel, the third end flap comprising a third closure flap, and the fourth end flap comprising a fourth closure flap, wherein the third and fourth end flaps are for forming an at least partially closed second end of the carton.

32. The carrier blank and divider blank of claim 29, wherein the central flap is connected to at least the second handle panel at the oblique fold line, the oblique fold line being that is spaced apart from the longitudinal fold line, the central flap for being positioned between the first and second divider panels when the carrier is formed from the carrier blank and the divider blank.

33. The carrier blank and divider blank of claim 32, wherein the at least one divider panel comprises a first divider panel and a second divider panel, and the at least one divider flap comprises a first divider flap, a second divider flap, a third divider flap and a fourth divider flap, wherein each of the first and third divider flaps is foldably connected to the first divider panel, and each of the second and fourth divider flaps is foldably connected to the second divider panel.

34. A method of forming a carrier for holding a plurality of containers, the method comprising:

obtaining a carrier blank comprising a plurality of panels comprising a first side panel, a second side panel, at least one handle panel, and a central flap foldably connected to the at least one handle panel;

obtaining a divider blank comprising at least one divider panel and at least one divider flap foldably connected to the at least one divider panel;

positioning the at least one divider panel to at least partially overlap at least the first side panel and the at least one handle panel; and forming an interior of the carrier by folding the panels of the plurality of panels about respective fold lines so that the first side panel is positioned opposite to the second side panel and the central flap divides the carrier into a first container-receiving space and a second container-receiving space, wherein at least a portion of the central flap is positioned below the at least one handle panel adjacent the at least one divider panel.

35. The method of claim 34, wherein the at least one divider panel comprises a first divider panel and a second divider panel, and the at least one handle panel comprises a first handle panel and a second handle panel, the positioning the at least one divider panel comprising positioning the first divider panel to be at least partially in face-to-face contact with the first side panel and the first handle panel and positioning the second divider panel to be at least partially in face-to-face contact with the second side panel and the second handle panel.

36. The method of claim 35, wherein the forming the interior of the carrier comprises folding the central flap relative to the at least one handle panel to be at least partially in face-to-face contact with at least one of the first divider panel and the second divider panel, and folding at least the second divider panel and the second side panel relative to the first divider panel and the first side panel about respective lateral fold lines.

37. The method of claim 36, wherein the carrier blank further comprises a first end flap foldably connected to the first side panel and a second end flap foldably connected to the second side panel, the forming the interior of the blank further comprising folding the first and second side panels relative to the respective first and second end flaps so as to position the first side panel opposite to the second side panel and to form an at least partially closed end of the carton.

38. The method of claim 37, wherein the first and second handle panels are respectively foldably connected to the first and second end flaps, and the carrier blank further comprises a third end flap foldably connected to the first side panel and a fourth end flap foldably connected to the second side panel, the method further comprising positioning the third and fourth end flaps to engage a slot formed between the first and second handle panels.

39. The method of claim 37, wherein the at least one divider flap comprises a first divider flap foldably connected to the first divider panel and a second divider flap foldably connected to the second divider panel, the method further comprising forming a plurality of container compartments by folding the first divider flap relative to the first divider panel and securing the first divider flap to the first side panel and folding the second divider flap relative to the second divider panel and securing the second divider flap to the second side panel.

40. A carrier for holding a plurality of containers, the carrier comprising:

a plurality of panels that extend at least partially around an interior of the carrier, the panels comprising a first side panel, a second side panel, and at least one handle panel;

at least one first end flap foldably connected to at least one panel of the plurality of panels and at least partially closing a first end of the carrier, wherein the at least one handle panel is foldably connected to the at least one first end flap at a first handle end; and a central flap foldably connected to the at least one handle panel at a second handle end, the central flap dividing the interior of the carrier into at least a first row and a second row, wherein at least a portion of the central flap extends below the at least one handle panel, and the central flap is generally parallel to the at least one handle panel.

41. The carrier of claim 40, further comprising a divider insert comprising at least one divider panel, wherein the at least one divider panel comprises a main panel extending generally parallel to the central flap and at least one divider flap foldably connected to the at least one main panel and extending to one of the first side panel and the second side panel to divide the respective first or second row into at least two container compartments.

42. A carrier blank for forming a carrier for holding a plurality of containers, the carrier blank comprising:

a plurality of panels comprising a first side panel, a second side panel, and at least one handle panel, wherein at least a portion of the at least one handle panel is separated from the second side panel along a first lateral cut line;

at least one first end flap foldably connected to at least one panel of the plurality of panels for at least partially closing a first end of the carrier formed from the carrier blank, wherein the at least one handle panel is foldably connected to the at least one first end flap at a first handle end; and a central flap foldably connected to the at least one handle panel at a second handle end along an oblique fold line, wherein at least a portion of the central flap is separated from the second side panel along a second lateral cut line, the second lateral cut line being collinear with the first lateral cut line, and the oblique fold line extending from the second lateral cut line, the central flap being for dividing the interior of the carrier formed from the carrier blank into at least a first container-receiving space and a second container-receiving space.

43. The carrier blank of claim 42, wherein the at least one handle panel, the central flap, and the first side panel at least partially form an opening in the carrier blank.

44. The carrier blank of claim 42 in combination with a divider blank for forming a divider of the carrier, wherein the divider blank comprises at least one divider panel and at least one divider flap foldably connected to the at least divider panel.

* * * * *

UNITED STATES PATENT AND TRADEMARK OFFICE

CERTIFICATE OF CORRECTION

PATENT NO. : 8,087,512 B2
APPLICATION NO. : 12/821657
DATED : January 3, 2012
INVENTOR(S) : Kirsten L. Brand It is certified that error appears in the above-identified patent and that said Letters Patent is hereby corrected as shown below:

Cover page, item (54), after "HANDLE" delete ", CENTRAL FLAP AND DIVIDER"

Column 1, line 1, after "HANDLE" delete ", CENTRAL FLAP"

Column 1, line 2, delete "AND DIVIDER"

Signed and Sealed this
Fourteenth Day of February, 2012

David J. Kappos

David J. Kappos
*Director of the United States Patent and Trademark Office*